US005670757A

United States Patent [19]

Harris

[11] Patent Number: 5,670,757

[45] Date of Patent: Sep. 23, 1997

[54] EXHAUST SILENCER FOR ENGINES AND GENERATORS

[75] Inventor: Frank E. Harris, Portland, Oreg.

[73] Assignee: Harco Manufacturing Company, Portland, Oreg.

[21] Appl. No.: 760,655

[22] Filed: Nov. 27, 1996

[51] Int. Cl.[6] ..... F01N 1/08

[52] U.S. Cl. ..... 181/264; 181/268; 181/274; 181/282

[58] Field of Search ..... 181/224, 238, 181/239, 240, 256, 258, 264, 267, 268, 269, 270, 272, 274, 281, 282

[56] References Cited

U.S. PATENT DOCUMENTS

| | | | |
|---|---|---|---|
| 2,513,229 | 6/1950 | Bourne et al. | 181/238 |
| 3,126,979 | 3/1964 | Marx | 181/282 X |
| 3,756,027 | 9/1973 | Gotoh et al. | 181/274 X |
| 3,887,032 | 6/1975 | Harris . | |
| 3,927,731 | 12/1975 | Lancaster | 181/267 |
| 4,122,913 | 10/1978 | Stemp | 181/264 X |
| 4,786,299 | 11/1988 | DeMarco | 181/270 X |

*Primary Examiner*—Khanh Dang

*Attorney, Agent, or Firm*—Klarquist Sparkman Campbell Leigh & Whinston, LLP

[57] ABSTRACT

An exhaust silencer for receiving exhaust gasses from an engine includes inner and outer cylindrical walls and top and bottom closure plates. The inner wall and the top and bottom closure plates define a central collection chamber. Baffles extend alternately from the inner cylindrical wall towards the outer cylindrical wall and from the outer cylindrical wall towards the inner cylindrical wall, so as to define an undulating path for exhaust gasses as they pass from the central collection chamber to an outlet. Sound insulating material is attached to each of the upstream surfaces of the baffles, to the outer surface of the central collection chamber, to the inner surface of the outer cylindrical wall, and to the inner surfaces of each of the top and bottom closure plates. The sound insulating material is protected by expanded metal. The baffles are attached at their vertical edges to the expanded metal and not to the actual inner and outer cylindrical walls themselves. Transmission of sound to the outer cylindrical wall is thus markedly reduced.

7 Claims, 3 Drawing Sheets

EXHAUST SILENCER FOR ENGINES AND GENERATORS

FIELD OF THE INVENTION

This invention relates to silencers for exhaust gasses discharged by engines and, more particularly, to silencers for engines used in emergency generators, also those used in marine applications.

BACKGROUND OF THE INVENTION

Most silencers or mufflers for engines are of the tubular type. These silencers are subject to many disadvantages, including being inefficient as well as expensive.

U.S. Pat. No. 3,887,032 disclosed an early example of what has become known as a "pancake" or "hockey puck" silencer. Such silencers are far more efficient than the traditional tubular type of silencer and, indeed, have become a very successful and popular design.

The inner construction of the pancake type of silencer has changed since the design of the '032 patent was first introduced. A successful evolutionary design has utilized inner and outer cylinders which define, with top and bottom plates, a toroidal chamber through which engine exhaust gasses pass.

The toroidal chamber in this evolutionary design has been divided into inlet and outlet chambers by a pair of partitions symmetrically disposed with respect to inlet means for the exhaust gases. Baffles have been disposed within the inlet chamber. The baffles typically extend alternately radially from the inner cylinder to the outer cylinder, and from the outer cylinder to the inner cylinder, so that exhaust gasses entering the inlet chamber are forced into an undulating path.

The partitions dividing the toroidal chamber into the inlet and outlet chambers have themselves been provided with openings such that the exhaust gasses can exit the inlet chamber and pass into the outlet chamber. The openings have been equipped with cylindrical tubes comprising vanes, whereby the exhaust gasses passing into the outlet chamber are given a rotational motion prior to being discharged from the outlet chamber.

In this design the partitions dividing the toroidal chamber into the inlet and outlet chambers have extended all the way from the inner cylinder to the outer cylinder, the ends of the partitions actually being welded to the respective cylinders. Also, the baffles which extend from the inner cylinder towards the outer cylinder have actually been welded to the inner cylinder at their inner ends; and the baffles which extend from the outer cylinder towards the inner cylinder have actually been welded to the outer cylinder at their outer ends. The baffles and the partitions have also been welded either to the top or bottom plate, depending on the particular design and the desired sequence of fabrication. (The baffles and partitions cannot be welded to both top and bottom plates because once one plate is so attached, welding access cannot be had to attach the other plate.)

With this type of construction, sound is easily transferred through the baffles and partitions to the outer cylinder. This, of course, is disadvantageous, but is inherent in the design because sound is transferred easily through metal.

Also, neither the tubular type of silencer nor the pancake type has been equipped with substantial amounts of interiorly disposed sound insulating material, such as Owens-Corning Corporation's Fiberglas® insulation, because installing such insulation in both these designs is difficult and thus has been very costly.

Accordingly, it is the principal object of the present invention to provide an exhaust silencer with less actual interior metal-to-metal contact than has been present in previous designs.

It is a further object of the present invention to provide an exhaust silencer with efficiently disposed interior sound insulating material, thereby to provide a silencer that will have much greater sound absorbing characteristics than has been heretofore available.

A still further object of the invention is to provide silencers of the pancake type with less actual metal-to-metal contact and with sound insulating material disposed in a highly efficient noise reducing manner.

DESCRIPTIONS OF THE PREFERRED EMBODIMENTS

Figure 1:
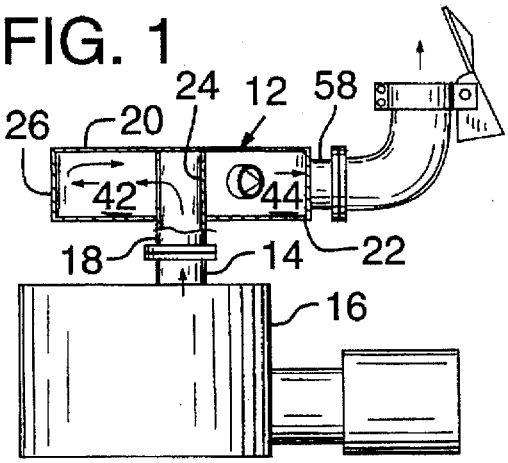
FIG. 1 is a diagrammatic elevational view of a first embodiment of a pancake type of exhaust silencer in accordance with the instant invention, the silencer illustrated in this figure being positioned atop a generator mounted on a building roof and used to generate electricity in case of an emergency.

Referring to the drawings, and particularly to FIG. 1, a pancake type of silencer 12 in accordance with the instant invention is illustrated mounted on top of an exhaust stack 14 of a building generator 16. Silencer 12 has a centrally positioned intake or inlet 18 which is bolted to stack 14 in known manner.

Figure 8:
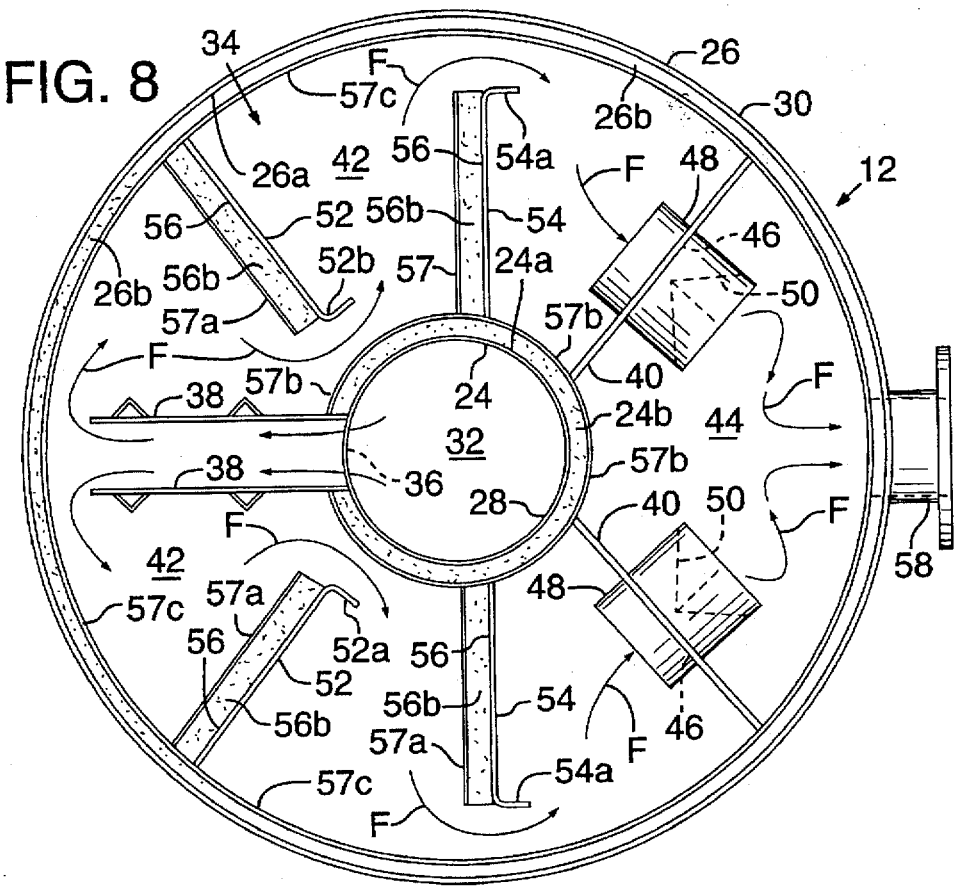
FIG. 8 is a horizontal sectional view through the silencer of FIG. 1.
Figure 9:
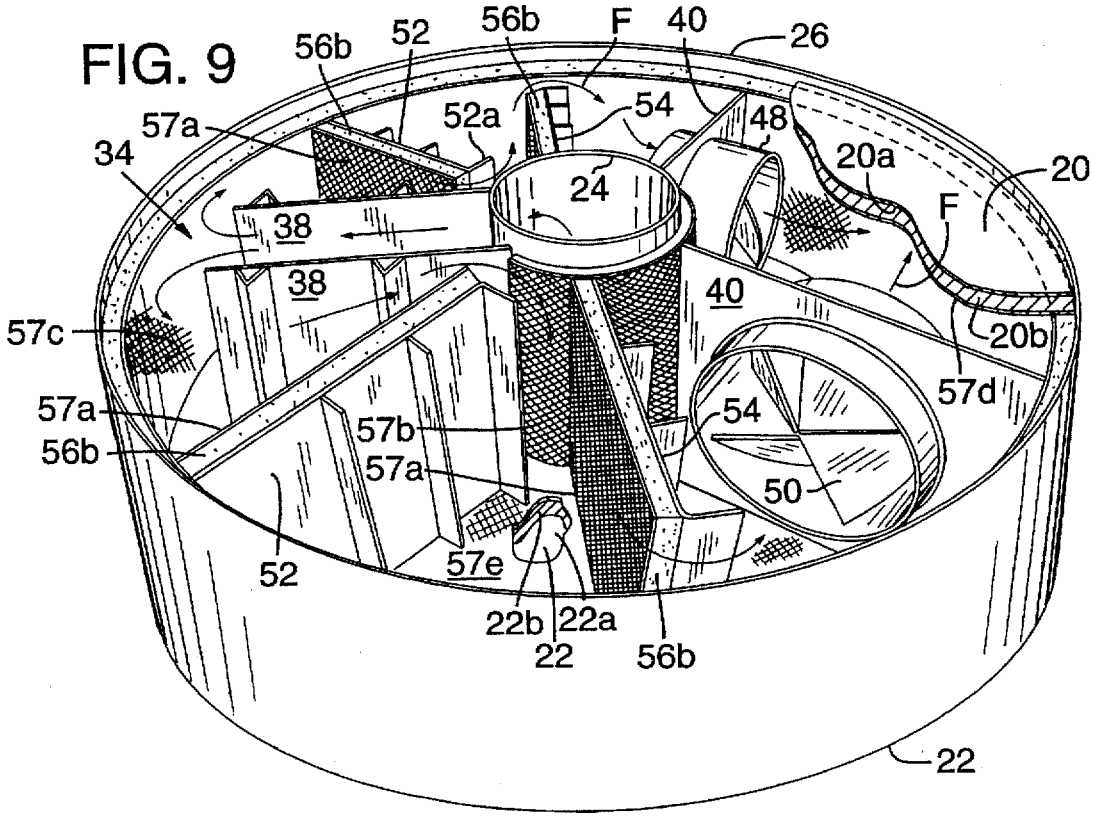
FIG. 9 is a perspective view of the silencer of FIGS. 1 and 8.

Silencer 12 includes circular top and bottom closure plates 20, 22 welded to inner and outer cylindrical double walls 24, 26. As shown in FIGS. 8 and 9, walls 24, 26 form inner and outer cylinders 28, 30. Inner cylinder 28 has a diameter substantially less than that of outer cylinder 30 and is positioned concentrically therewithin, as shown. Plates 20 and 22 together with inner cylindrical wall 24 form a central collection chamber 32. Plates 20, 22 together with inner and outer cylindrical walls 24, 26 form a hollow toroidal chamber 34. Outer cylindrical wall 26 together with top and bottom closure plates 20, 22 define the external surfaces of silencer 12.

As shown in FIGS. 1 and 8, inlet 18 communicates with chamber 32 to receive exhaust gasses from generator 16. As shown in FIG. 8, the gasses exit chamber 32 through an opening 36, passing between two symmetrically placed guide plates 38, which are welded to inner cylinder 28 and to either top or bottom plates 20 and 22, into toroidal chamber 34.

A pair of symmetrically placed partitions 40 divide toroidal chamber 34 into an inlet chamber 42 and an outlet chamber 44. Again, partitions 40 are welded to either top or bottom plates 20, 22, but they are not welded to inner and outer cylinders 28, 30, as will be more fully described hereinafter.

Each of partitions 40 includes an opening 46 to permit communication between chambers 42 and 44. A cylinder 48 having a plurality of vanes 50 is mounted in each of openings 46. Vanes 50 are adapted to rotate gasses passing through cylinders 48. Openings 46 permit communication between inlet chamber 42 and outlet chamber 44.

As shown in FIGS. 8 and 9, two pairs of symmetrically placed baffles 52, 54 extend, respectively, from a position adjacent outer wall 26 and from a position adjacent inner wall 24, alternately as shown. Specifically, baffles 52 extend generally radially from a position adjacent the inner surface 26*a* of outer wall 26 towards inner wall 24; and baffles 54 extend generally radially from a position adjacent the outer surface 24*a* of inner wall 24 towards outer wall 26. Each of baffles 52, 54 comprises an L-shaped plate, with the foot or short ends 52*a*, 54*a*, respectively, extending in the direction of gas flow F. The group of baffles thus define an undulating path along which exhaust gasses must pass as they travel through inlet chamber 42 on their way towards openings 46 in partitions 40. Each of baffles 52, 54 presents an upstream or sound-impinging surface 56 towards the flow of gasses as shown.

Sound insulating material 56*b* comprising, for example, one inch thick Owens-Corning Corporation Fiberglas® insulation, retained in position and protected by a one-half inch 13 gauge expanded metal covering 57*a*, is attached by tack-welding the expanded metal covering 57*a* to each upstream or sound-impinging surface 56 of each of baffles 52, 54. Expanded metal suitable for use as covering 57*a* is obtainable from many sources, one for example, being EMI, Incorporated, Seattle, Wash.

(In the following description, the expanded metal covering which protects the insulation is referred to in all cases by the prefix numeral 57. However, the covering used at each specific location in silencer 12 is further identified by using a different lower-case letter as a suffix to distinguish the covering at the specific location from coverings used at other locations.)

Thus, besides attaching sound insulating material 56*b* having expanded metal covering 57*a* on surfaces 56 of baffles 52, 54, sound insulating material 24*b* having expanded metal covering 57*b* is attached to outer surface 24*a* of inner cylindrical wall 24; sound insulating material 26*b* having expanded metal covering 57*c* is attached to inner surface 26*a* of outer cylindrical wall 26; sound insulating material 20*b* having expanded metal covering 57*d* is attached to the inner or lower surface 20*a* of top closure plate 20 (see FIG. 9); and sound insulating material 22*b* having expanded metal covering 57*e* is attached to the inner or upper surface 22*a* of bottom closure plate 22 (also see FIG. 9).

The specific means of attachment of baffles 52 and 54 and of partitions 40 will now be described. The upper and lower edges of baffles 52 are welded to either the top or bottom closure plates 20, 22 as previously noted. The outermost vertical edge is welded to the expanded metal covering 57*c* protecting insulation 26*b*. The welded plate 20 or 22 provides a rigid attachment for the baffle, which itself then provides support for insulation 26*b* and its expanded metal covering 57*c*.

Similarly, the upper and lower edges of baffles 54 are welded to either the top or bottom closure plates 20, 22, but in this case it is the innermost vertical edge which is welded to the expanded metal covering 57*b* protecting insulation 24*b*. Thus, the welded plate 20 or 22 provides the rigid attachment for the baffle 54, which itself then provides support for insulation 24*b* and its expanded metal covering 57*b*.

Similarly, the upper and lower edges of partitions 40 are welded to either the top or bottom closure plates 20, 22, respectively, but their inner and outer vertical edges are welded to the expanded metal coverings 57*b*, 57*c* protecting insulation 24*b* (inner cylinder 24) and insulation 26*b* (outer cylinder), respectively.

The particular design of the silencer of this invention makes attachment of such sound insulating material economically feasible, whereas heretofore this was not the case at all.

In operation, exhaust gasses from engine 16 emitted through stack 14 are received by inlet 18 and pass into central collection chamber 32. The gasses then pass between symmetrical guide plates 38, impinging on insulating material 26*b* (and its covering 57*c*) on inner surface 26*a* of outer wall 26, whereupon the gasses are substantially equally divided as they enter inlet chamber 42. The gasses then travel along the undulating path established by baffles 52, 54, allowing the sound to impinge on insulating material 56*b* (and its coverings 57*a*) on the upstream surfaces 56 of baffles 52, 54, the flow passing through cylinders 48 in openings 46 in partitions 40, where the gasses are given a rotational motion by vanes 50 as the flow enters outlet chamber 44. An outlet 58 in outer cylindrical wall 26 discharges the gasses to atmosphere. Noise reduction achieved by this design is superior to anything heretofore achieved.

Figure 2:
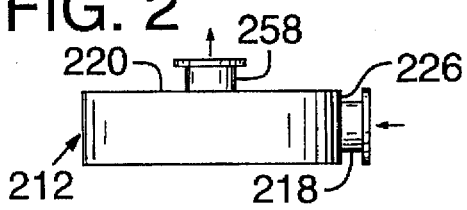
FIGS. 2, 3, 4, 5, 6 and 7 are similar elevational views of additional embodiments, each illustrating just the silencer.

The design permits numerous variations in reception and discharge of engine exhaust gasses. FIG. 2 illustrates a silencer 212 having an inlet 218 in its exterior wall 226 and a centrally placed outlet 258 in its top closure plate 220.

Figure 3:
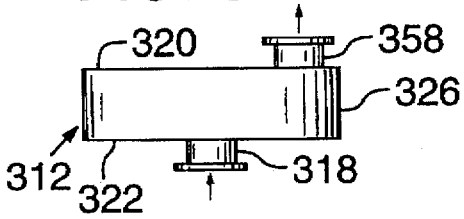

FIG. 3 illustrates a silencer 312 having a centrally placed inlet 318 in its bottom closure plate 322, as in FIG. 1, and a peripherally placed outlet 358 in its top closure plate 320, outlet 358 being generally adjacent the outer wall 326.

Figure 4:
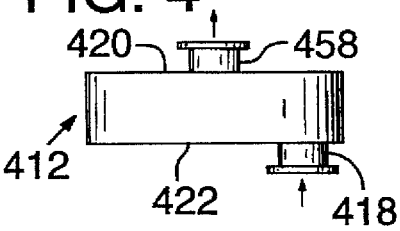

FIG. 4 illustrates a silencer 412 having a peripherally placed inlet 418 in its bottom closure plate 422 and a centrally placed outlet 458, as in FIG. 2, in its top closure plate 420.

Figure 5:
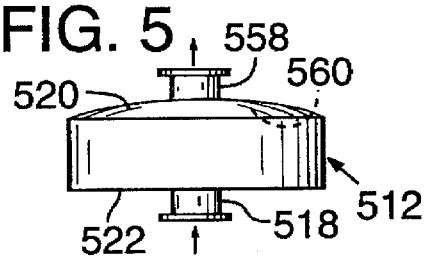

FIG. 5 illustrates a silencer 512 having a centrally placed inlet 518 in its bottom closure plate 522, as in FIG. 3, and a centrally placed outlet 558 communicating with an opening (not shown) in its top closure plate 520, exhaust gas being collected in a plenum 560 before final discharge.

Figure 6:
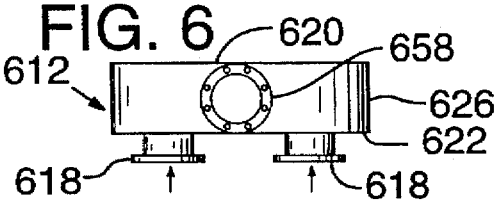

FIG. 6 illustrates a silencer 612 having two symmetrically placed inlets 618 in its bottom closure plate 622. Gasses are discharged to atmosphere through an outlet 658 in its outer cylindrical wall 626. The details of construction are as illustrated in FIG. 10.

Figure 10:
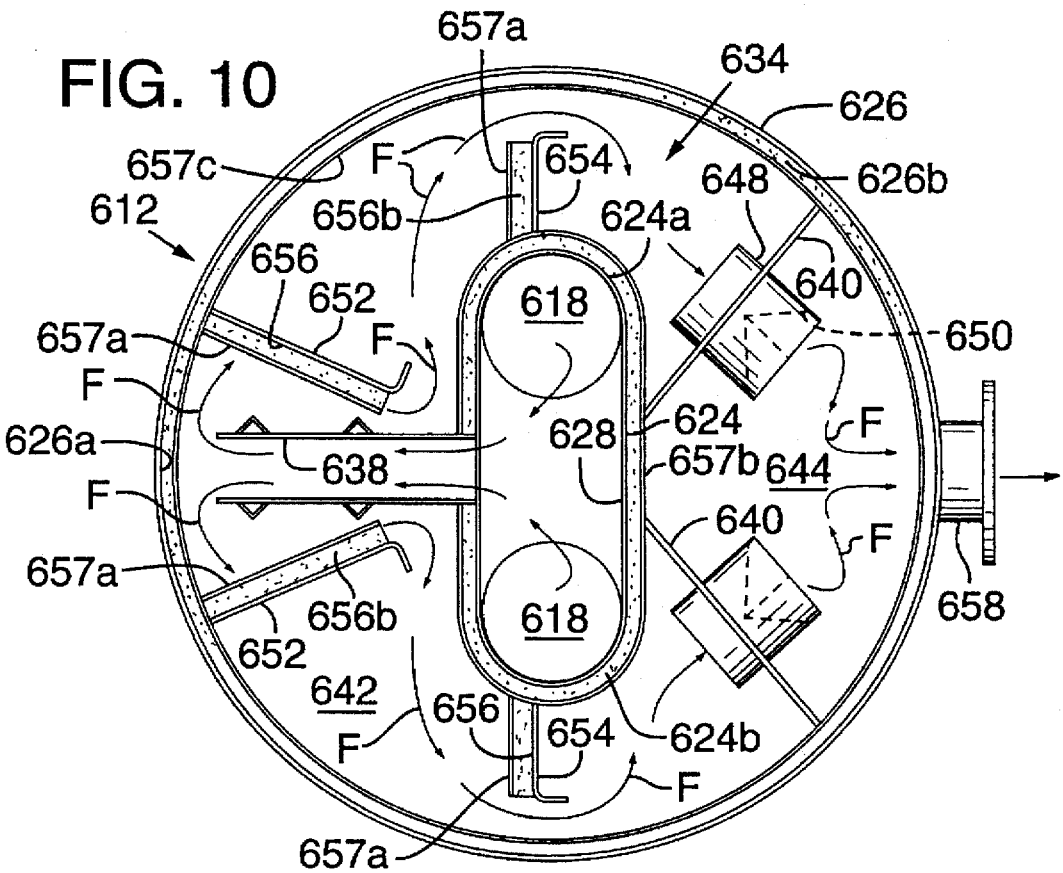
FIG. 10 is a sectional view, similar to FIG. 8, through the silencer of FIG. 6.

As shown in FIG. 10, silencer 612 comprises an inner cylinder 628, which is laterally elongated as compared with cylinder 28 in the embodiment of FIGS. 1, 8 and 9. Otherwise the construction is as illustrated in connection with the embodiment of FIGS. 1, 8 and 9, and is illustrated in FIG. 10 with the respective parts numbered similarly except for being in the 600 series.

As shown in FIGS. 6 and 10, silencer 612 includes top and bottom closure plates 620, 622 welded to inner and outer cylindrical double walls 624, 626, cylindrical inner double wall 624 being in the laterally elongated form shown and forming an inner elongated cylinder 628. Cylinder 628 is positioned concentrically within cylindrical outer double wall 626. Cylinder 628 forms the central collection chamber. Top and bottom plates 620, 622 together with inner and outer cylindrical walls 624, 626 form a hollow toroidal chamber 634.

Inlets 618 communicate with the laterally elongated central collection chamber formed by cylinder 628 and receive gasses from an engine or generator (not shown). The gasses exit from the central collection chamber and pass between two symmetrically placed guide plates 638 into toroidal chamber 634. Again, as in the embodiment of FIGS. 1, 8 and 9, a pair of symmetrically placed partitions 640 divide toroidal chamber 634 into an inlet chamber 642 and an outlet chamber 644.

As shown in FIG. 10, and similarly to the embodiment of FIGS. 1, 8 and 9, each partition 640 includes a cylinder 648 received in an opening, cylinders 648 each including a plurality of gas rotating vanes 650, cylinders 648 permitting communication between inlet and outlet chambers 642, 644.

Two pairs of symmetrically placed baffles 652, 654 are positioned with respect to outer wall 626 and inner wall 624, alternately as shown. As in the embodiment of FIGS. 1, 8 and 9, either the upper or lower edge of each of each baffle 652 is welded to the top or bottom closure plates 620, 622; and the outer vertical edges of baffles 652 are welded to the expanded metal covering 657*c* protecting sound insulation material 626*b* attached to the inner surface 626*a* of outer cylindrical wall 626. Baffles 652 extend generally radially from outer wall 626 towards inner wall 624.

Similarly, the upper and lower edges of baffles 654 are welded to either top or bottom closure plates 620, 622; and their inner vertical edges are welded to the expanded metal covering 657*b* protecting the sound insulation material 624*b* attached to the outer surface 624*a* of inner cylindrical wall 624. Baffles 654 extend generally radially from inner wall 624 towards outer wall 626.

As in the embodiment of FIGS. 1, 8 and 9, each of baffles 652, 654 comprises an L-shaped plate with its foot or short end extending in the direction of flow F. The group of baffle define an undulating path along which exhaust gasses must pass as they travel through inlet chamber 642 on their way towards cylinders 648 in partitions 640 and thence into outlet chamber 644. Each of baffles 652, 654 presents an upstream or sound-impinging surface 656 towards the flow of gasses as shown.

As in the embodiment of FIGS. 1, 8 and 9, sound insulating material 656*b* comprising, for example, one inch thick Owens-Corning Corporation Fiberglas® insulation retained in position and protected by one-half inch 13 gauge expanded metal 657*a*, is attached to each upstream or sound-impinging surface 656 of each of baffles 652, 654 by tack welding or similar means. As noted hereinabove, sound insulating material 624*b* is attached to the outer surface 624*a* of inner cylindrical wall 624; sound insulating material 626*b* is attached to the inner surface 626*a* of outer cylindrical wall 626; and sound insulating material is attached to the inner or lower surface of top closure plate 620 and to the inner or upper surface of bottom closure plate 622.

As in the embodiment of FIGS. 1, 8 and 9, welding either of plates 620, 622 to baffles 652, 654 provides a means of rigidly supporting the baffles, which then provide support for insulation 626*b* and its expanded metal covering 657*c*, and for insulation 624*b* and its expanded metal covering 657*b*.

As in the embodiment of FIGS. 1, 8 and 9, either the upper or lower edges of partitions 640 are welded to top or bottom closure plates 620, 622; their inner and outer vertical edges are welded to the expanded metal coverings 657*b*, 657*c* protecting the insulation 624*b* (inner cylinder 624) and insulation 626*b* (outer cylinder), respectively. The partitions support the insulation and its expanded metal covering as aforesaid.

In operation, exhaust gasses from the engine are received by inlets 618 and pass into the central collection chamber formed by cylinder 628. The gasses then pass between symmetrical guide plates 638, impinging on insulating material 626*b* and its covering 657*c* on inner surface 626*a* of outer wall 626, whereupon they are substantially equally divided as they enter inlet chamber 642. The gasses then travel along the undulating path established by baffles 652, 654, the sound impinging on insulating material 656*b* and its covering 657*a* on the upstream surfaces 656 of baffles 652, 654; the gasses then pass through cylinders 648 in partitions 640, and are given a rotational motion by vanes 650 as they enter outlet chamber 644. The gasses are discharged to atmosphere through outlet 658 in outer cylindrical wall 626.

Figure 7:
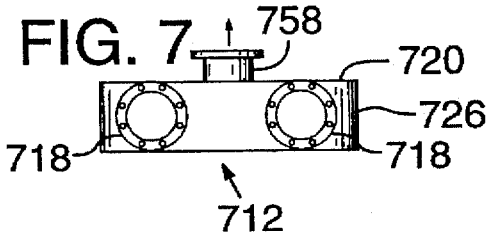

FIG. 7 illustrates a silencer 712 having two inlets 718 in its exterior wall 726 and a centrally placed outlet 758 in its top closure plate 720, as in FIGS. 2 and 4.

Figure 11:
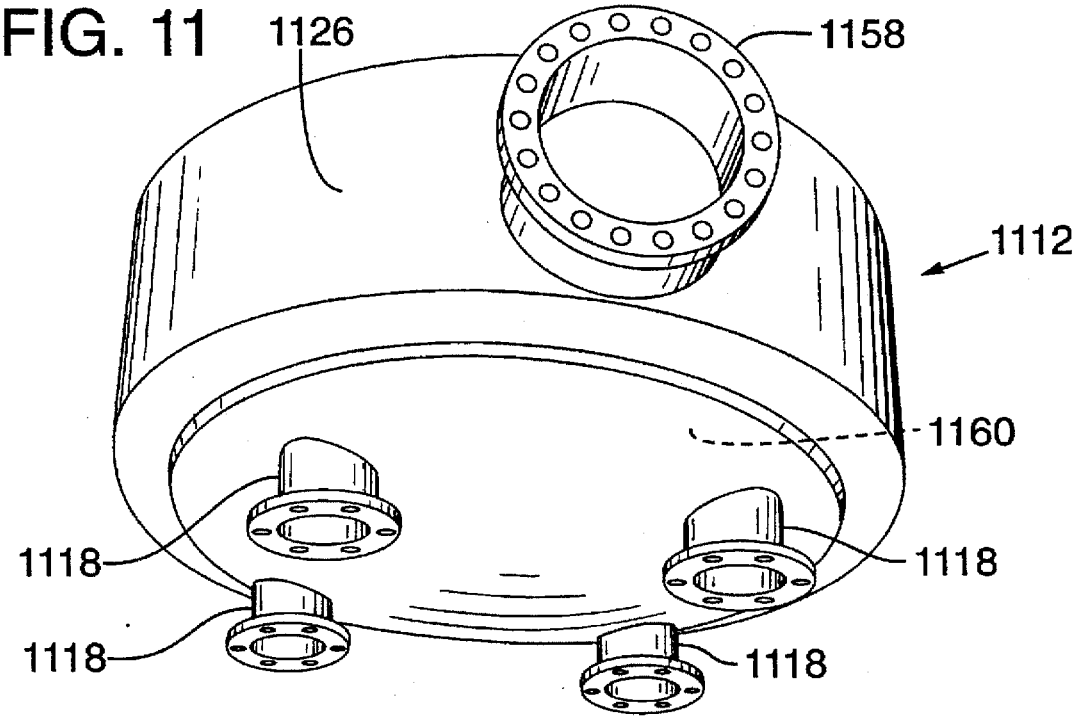
FIG. 11 is a perspective view of the exterior of a silencer like that of FIGS. 1, 8 and 9, but modified to accommodate an engine having four vertical exhaust ports.

FIG. 11 illustrates a silencer 1112' specifically designed for use with a Detroit Diesel® 2000 kw diesel engine, Model 20V149 TIB, which has four exhaust ports (not shown). Silencer 1112 has four inlets 1118 which accept exhaust gasses from the engine and introduce them into a bottom plenum 1160. The exhaust gasses then enter a central collection chamber (not shown), as in the embodiment of FIGS. 1, 8 and 9. Exhaust gasses are ultimately discharged to atmosphere through an outlet 1158 in an outer cylindrical wall 1126. The design reduces noise from this particular engine to a level that has not been possible heretofore with any other silencer.

As is evident, my design permits a multiple of choices for inlet and outlet location. Such multiple configurations permit use in situations where space is at a premium. Noise reduction is achieved to a degree superior to that achieved by any other silencer now available.

I claim:

1. In an exhaust silencer, an outer cylinder of a predetermined diameter;

an inner cylinder of a diameter substantially less than the diameter of the outer cylinder and positioned concentrically within the outer cylinder;

exhaust gas inlet means communicating with the inner cylinder;

top and bottom closure plates sealed to the inner and outer cylinders and forming a toroidal chamber therewith;

a pair of partitions dividing the toroidal chamber into an inlet chamber and an outlet chamber, each of the partitions comprising an opening to permit communication between the inlet chamber and the outlet chamber;

exhaust gas outlet means communicating with the outlet chamber;

a plurality of baffles disposed within the inlet chamber and extending alternately generally radially from the inner cylinder towards the outer cylinder and from the outer cylinder generally radially towards the inner cylinder, the baffles defining an undulating path for exhaust gasses as they travel within the inlet chamber, each of the baffles comprising an upstream surface against which sound impinges as the exhaust gasses travel within the inlet chamber;

sound insulating material attached to the upstream surfaces of each of the baffles;

sound insulating material attached to the outer surface of the inner cylinder;

sound insulating material attached to the inner surface of the outer cylinder; and a protective covering on the sound insulating material attached to the baffles, to the inner cylinder and to the outer cylinder, the vertical edges of each of the partitions and the baffles being attached to the protective covering, whereby sound is not transmitted through the partitions and the baffles to the outer cylinder.

2. The exhaust silencer of claim 1, further comprising sound insulating material attached to the inner surface of the bottom closure plate.

3. The exhaust silencer of claim 1, further comprising sound insulating material attached to the inner surface of the top closure plate.

4. The exhaust silencer of claim 1, wherein the pair of partitions and the baffles are symmetrically placed.

5. The exhaust silencer of claim 4, wherein the inlet means comprises an opening in the inner cylinder symmetrically disposed with respect to the partitions and the baffles, whereby the exhaust gasses entering the inlet chamber are substantially equally divided.

6. The exhaust silencer of claim 1, wherein each of the openings in each of the partitions comprises a cylindrical tube and a plurality of vanes disposed in the cylindrical tube, the vanes being adapted to rotate the exhaust gasses as they pass through the cylindrical tube into the outlet chamber.

7. An exhaust silencer comprising:

an outer cylinder of a predetermined diameter;

an inner cylinder of a diameter substantially less than the diameter of the outer cylinder and positioned concentrically within the outer cylinder;

top and bottom plates sealed to the inner and outer cylinders and forming a toroidal chamber therewith;

a pair of symmetrically placed partitions dividing the toroidal chamber into an inlet chamber and an outlet chamber, each of the partitions comprising an inner vertical edge adjacent the inner cylinder and an outer vertical edge adjacent the outer cylinder, each of the partitions further comprising a first opening to permit communication between the inlet and the outlet chambers;

a cylindrical tube disposed in each of the first openings;

a plurality of vanes disposed in each of the tubes;

a plurality of symmetrically placed baffles disposed within the inlet chamber and extending alternately generally radially from the inner cylinder towards the outer cylinder and from the outer cylinder towards the inner cylinder, the baffles defining an undulating path, each of the baffles comprising an upstream surface against which sound impinges, each of the baffles comprising an L-shaped plate;

inlet means leading into the inner cylinder;

the inner cylinder comprising a second opening communicating with the inlet chamber, the second opening being symmetrically disposed with respect to the partitions and the baffles, whereby exhaust gasses entering the inlet chamber are substantially equally divided before impinging on the upstream surfaces of the baffles;

sound insulating material attached to each of the upstream surfaces of the baffles;

sound insulating material attached to the outer surface of the inner cylinder;

sound insulating material attached to the inner surface of the outer cylinder;

sound insulating material attached to the inner surfaces of each of the top and bottom plates;

expanded metal covering attached to the sound insulating material to protect the same;

the inner vertical edges of each of the partitions being attached to the expanded metal covering attached to the insulating material attached to the outer surface of the inner cylinder;

the outer vertical edges of each of the partitions being attached to the expanded metal covering attached to the insulating material attached to the inner surface of the outer cylinder, whereby sound is not transmitted through the partitions to the outer cylinder;

the inner vertical edges of each of the baffles which extend from the inner cylinder towards the outer cylinder being attached to the expanded metal covering attached to the insulating material attached to the outer surface of the inner cylinder;

the outer vertical edges of each of the baffles which extend from the outer cylinder towards the inner cylinder being attached to the expanded metal covering attached to the insulating material attached to the inner surface of the outer cylinder, whereby sound is not transmitted through the baffles to the outer cylinder; and outlet means communicating with and leading out of the outlet chamber.

* * * * *